United States Patent [19]

Gsell et al.

[11] 4,036,266

[45] July 19, 1977

[54] TAKE-UP MOTION FOR LOOMS

[75] Inventors: Siegbert Gsell, Neuravensburg; Hans Geiger; Hans-Jürgen Maierhofer, both of Lindau, all of Germany

[73] Assignee: Lindauer Dornier Gesellschaft mbH., Germany

[21] Appl. No.: 672,736

[22] Filed: Apr. 1, 1976

[30] Foreign Application Priority Data

Apr. 17, 1975 Germany ..... 2516888

[51] Int. Cl.[2] ..... D03D 49/20

[52] U.S. Cl. ..... 139/304; 139/309; 66/149 R

[58] Field of Search ..... 139/304–316; 66/149

[56] References Cited

U.S. PATENT DOCUMENTS

| | | | |
|---|---|---|---|
| 2,813,551 | 11/1957 | Shorter | 139/304 X |
| 3,730,230 | 5/1973 | Kodis | 139/304 X |
| 3,753,452 | 8/1973 | Zebley | 139/311 |

FOREIGN PATENT DOCUMENTS

| | | | |
|---|---|---|---|
| 195,948 | 1/1924 | United Kingdom | 139/312 |

*Primary Examiner*—James Kee Chi
*Attorney, Agent, or Firm*—James E. Bryan

[57] ABSTRACT

This invention relates to an improvement in a cloth take-up motion for looms with gradual or intermittent taking-up of cloth in which a take-up roller is adapted to be driven by drive shaft means and gear system means, and wherein the drive shaft executes one revolution with each weft insertion, the improvement comprising crank means and pin means on said drive shaft means, Maltese cross means in which said pin means is adapted to engage, and reduction gear means connecting said Maltese cross means with said take-up roller.

3 Claims, 5 Drawing Figures

TAKE-UP MOTION FOR LOOMS

The present invention relates to a take-up motion for looms with step-wise or intermittent taking-up or drawing-off of the cloth, whereby a take-up roller is adapted to be driven by a drive shaft by means of a gear system, and wherein the drive shaft executes one revolution with each weft.

Known in the art are looms with a continuous taking-up or pulling-off of the material by way of spur gears which are driven from the loom. The regulator or take-up motion is effective during the forward and the reverse movement of the loom. Stopping of the regulator for a desired number of wefts is not possible since the gears are constantly in meshing engagement with each other.

Further known in the art are pawl regulators in which a gradual cloth draw-off means of a pawl and ratchet wheel action is provided, which pawl is driven by the loom by way of a piston rod. The regulator may be stopped for a desired number of wefts by liftng out the pawl. A switching function in the reverse movement of the loom is not possible.

It is the object of the present invention to provide for a take-up regulator for looms which is adapted to be stopped for a desired number of wefts, and which is fully effective also during the reverse movement of the loom.

This object is obtained, in accordance with the present invention, by virtue of the fact that the drive shaft is provided with a crank whose pin engages in a disengageable manner into recesses of a Maltese cross which wheel is in operative connection with the take-up roller by means of a reduction gear. The Maltese cross gear renders possible an exactly reproducible return travel of the loom. The take-up motion may be stopped for a specific number of wefts by disengaging the pin from the recesses.

According to the present invention it is advantageous, moreover, that the crankpin be axially displaceably positioned in the crank arm and adapted to be disengaged from the Maltese cross by means of an electromagnet by way of a shifting linkage system.

In another advantageous embodiment of the present invention, the Maltese cross is in operative connection with the take-up roller by way of a self-locking worm gear and change gears.

A stretching or loosening of the material via the take-up roller is manually possible, while by-passing the regulator gear system, by uncoupling a jaw clutch at the driven regulator shaft.

Further advantages, features, and possibilities of application of the present invention will become apparent from the following description of the accompanying drawings, wherein FIG. 1 is a view of an inventive take-up motion, FIG. 2 is a sectional view of the take-up motion taken along line A-B-C-D of FIG. 1;

Figure 1:
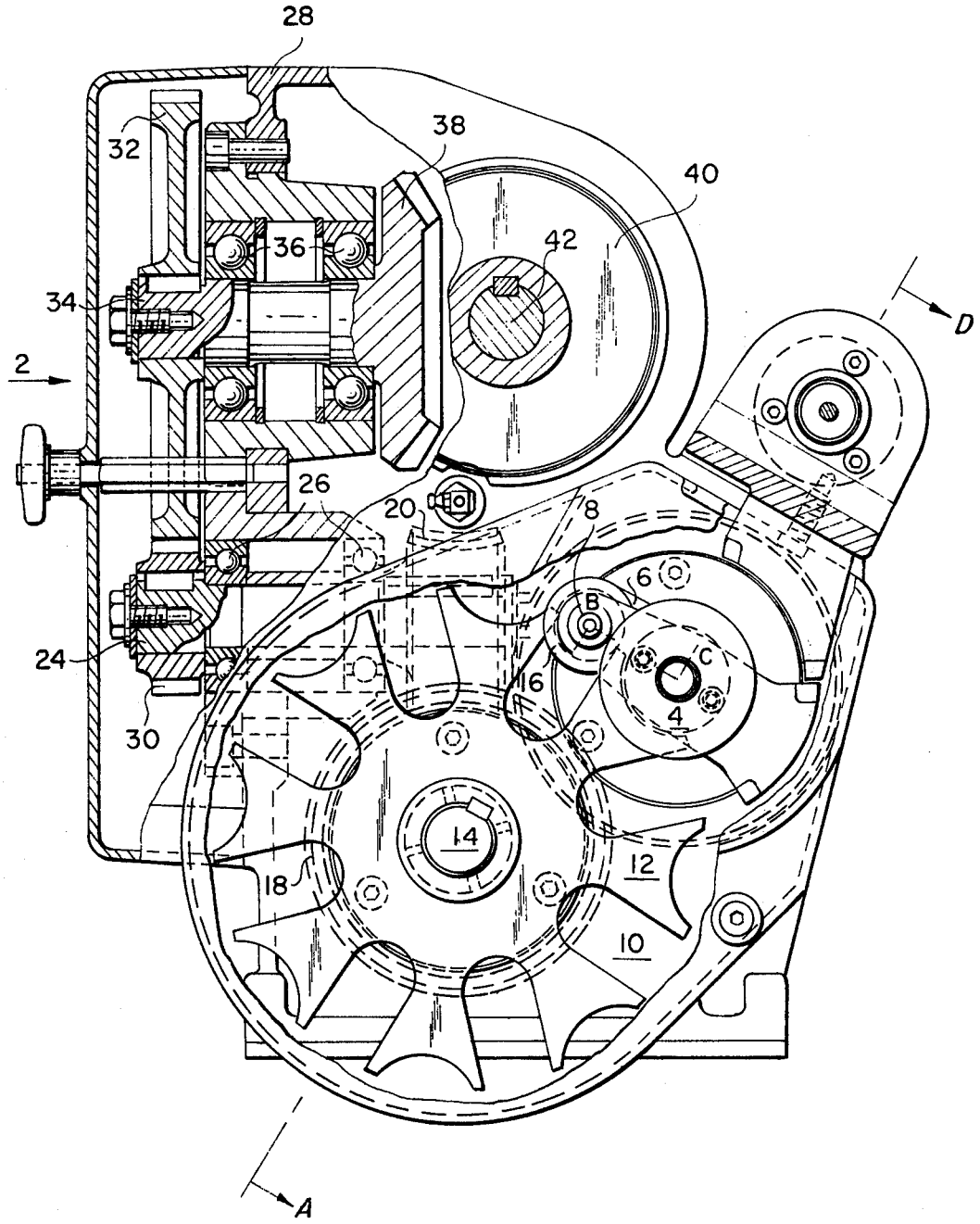

In FIG. 1 the entire take-up motion is identified with reference numeral 2. Shown in a top plan view thereof is a drive shaft 4 which executes one full revolution at each weft insertion of the loom. Mounted at the end of the drive shaft 4 is a crank 6 with a crankpin 8. This crankpin 8 engages into recesses 10 of a Maltese cross 12 which is mounted on a shaft 14. For the purpose of reducing friction, the crankpin 8 is provided with a roller 16 which is more clearly visible in FIG. 2.

Mounted on the shaft 14 is a worm gear 18 which is in operative connection with a worm gear 20, shown in phantom, and mounted on a shaft 24. The shaft 24 is rotatably mounted within the housing 28 by means of the bearings 26 and carries a gear 30 at is other end meshing with a second gear 32. The gears 30 and 32 are replaceable and may be replaced by other gears for the purpose of varying the gear progression.

The gear 32 is secured to a shaft 34 which is mounted within the housing 28 by means of the bearings 36. At the end of the shaft 34 is a bevel gear 38 which meshes with a bevel gear 40 which is mounted on a shaft 42. The shaft 42 drives a take-up roller (shown in FIG. 5 as number 82) by way of a train of gears 68, 77, 78, 79, and 80, which are partly fitted on an adjustable gear bracket 81.

Figure 2:
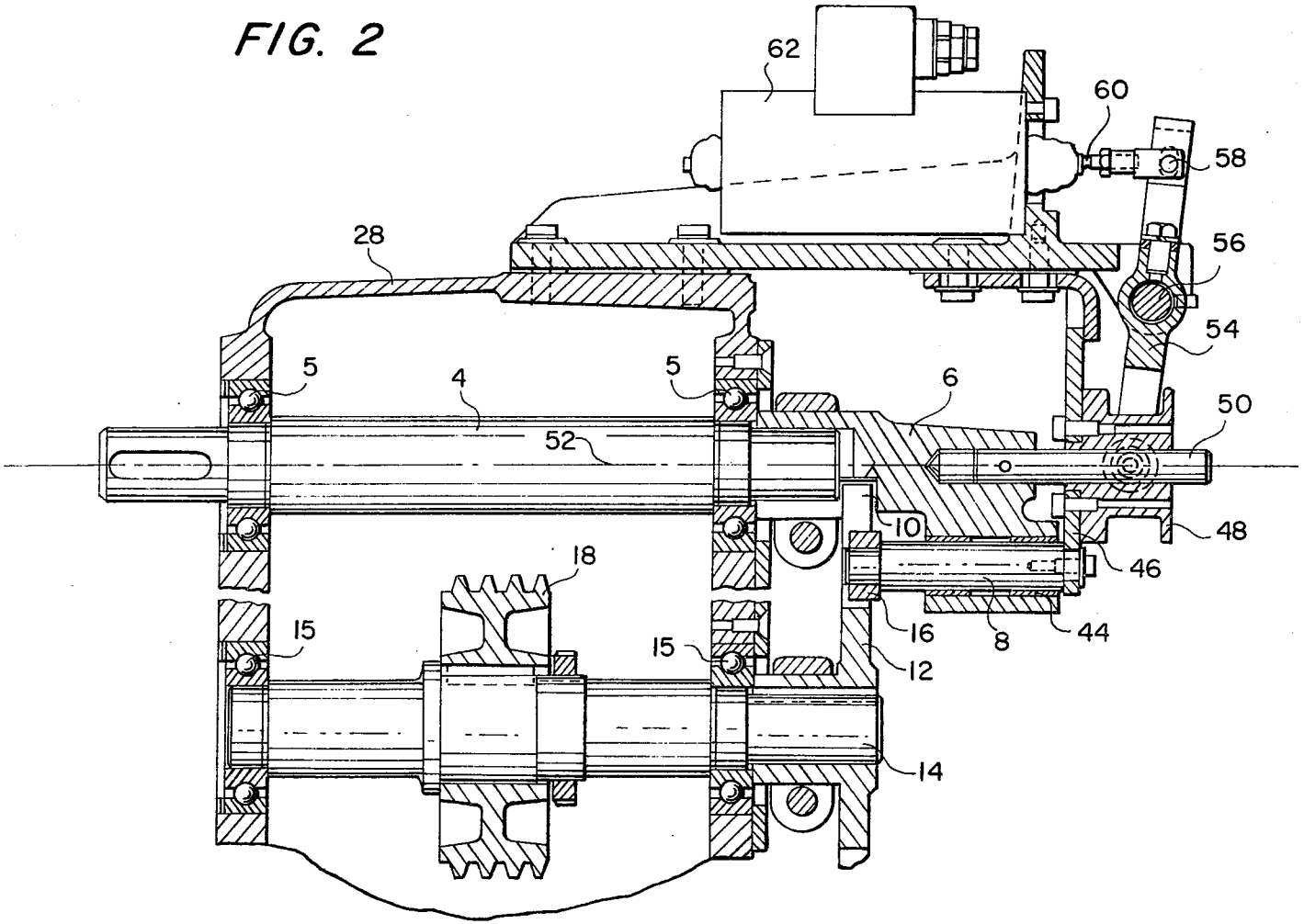

FIG. 2 is a sectional view through the Maltese cross and the crank, and the structural parts described in FIG. 1 have the same reference numerals. The drive shaft 4 is mounted by means of the antifriction bearings 5 within the housing 28 and executes one full revolution at each weft insertion. Mounted within its crank arm 6 is a crankpin 8 which is displaceable in the axial direction by means of a friction bearing 44. The end of the crankpin 8 facing away from the Maltese cross 12 is provided, via a plate 46, with a gearshift sleeve 48 which is mounted on a pin 50 in a manner such as to be displaceable in the axial direction. The axis of rotation 52 of the drive shaft 4 is also the axis of rotation of the pin 50. The gearshift sleeve 48 is in operative connection with a shift fork 54 which is pivotally mounted at 56 at the housing 28. It is, furthermore, connected by means of a pin 58 with a pull rod 60 which may be moved in the axial direction by an electromagnet 62.

Figure 3:
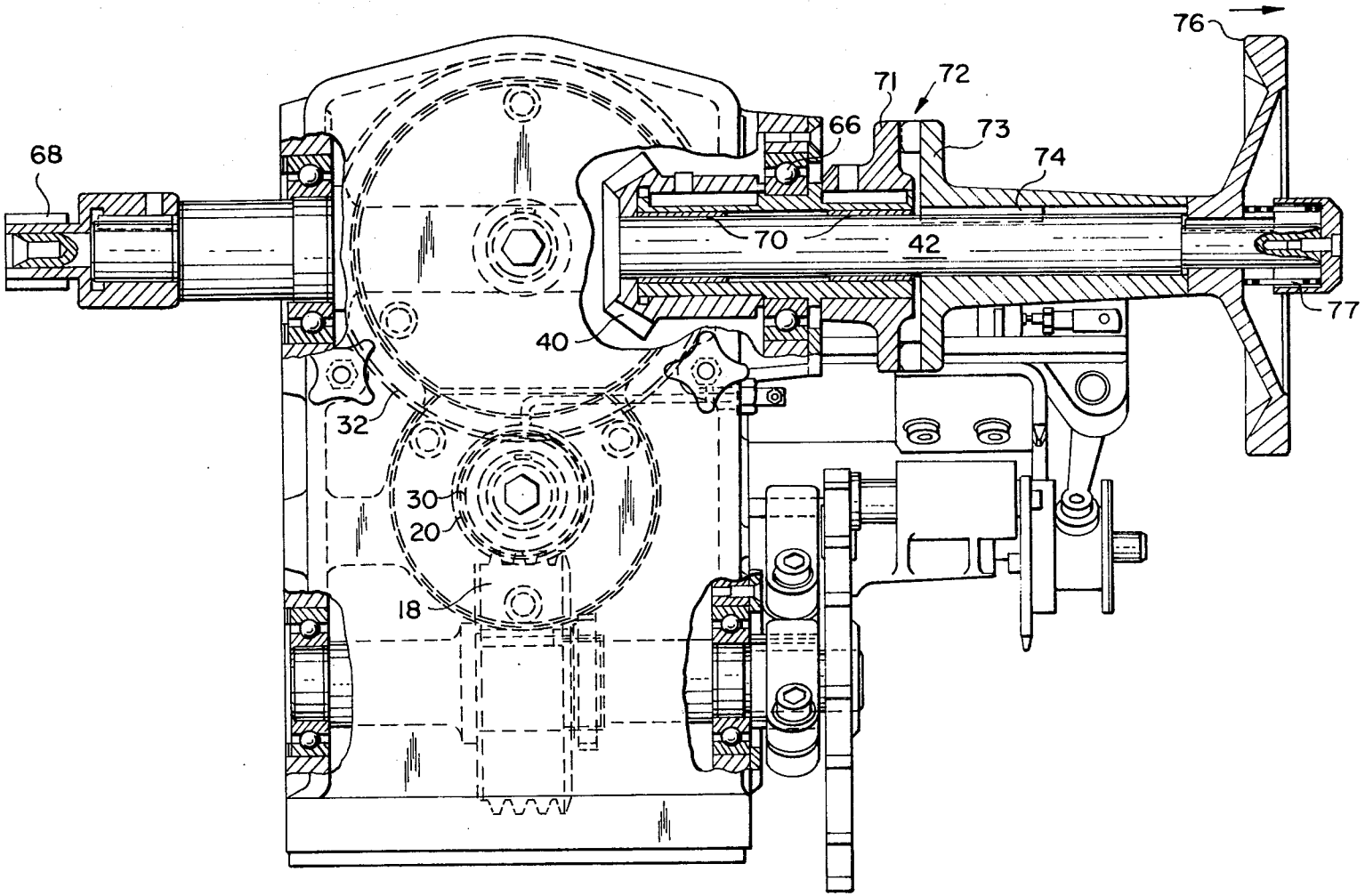
FIG. 3 is a side view of the take-up motion of FIG. 1.

When the pull rod 60 is actuated by the electromagnet 62, the gearshift sleeve 48 is displaced in the axial direction by means of the shift fork 54. Also the pin 8 together with the roller 16 is moved in the axial direction, whereby the roller 16 will be out of engagement with the Maltese cross 12. It is also readily apparent from FIG. 2 that the shaft 14, on which the Maltese cross 12 is mounted, is mounted within the housing 28 by means of the bearings 15. Shown in this sectional view is the worm gear 18 also mounted on this shaft. For greater clarity in the drawing, the worm gear 20 meshing with the worm gear 18 is not shown in this figure, but is shown in phantom in FIG. 3. Shown there in a top plan view are also the change gears 30 and 32, and the bevel gear 40 is shown in a sectional view.

The bevel gear 40 is rotatable on the shaft 42 by means of the bearings 70 so that its rotary movement is transmitted to the shaft 42 only by way of a disconnectable jaw clutch 72 by means of the adjusting spring 74.

A handwheel 76 mounted at the end of the shaft 42 may be moved in the direction of the arrow against the action of a spring 77, whereby both parts 71 and 73 of the jaw clutch 72 will be disengaged. When the handwheel 76 is rotated while the jaw clutch 72 is disengaged, a stretching or loosening of the cloth may take place by means of a gear 68 by way of a take-up roller 82 while by-passing the regulator 2 via the gear train 77, 78, 79, and 80.

Figure 4:
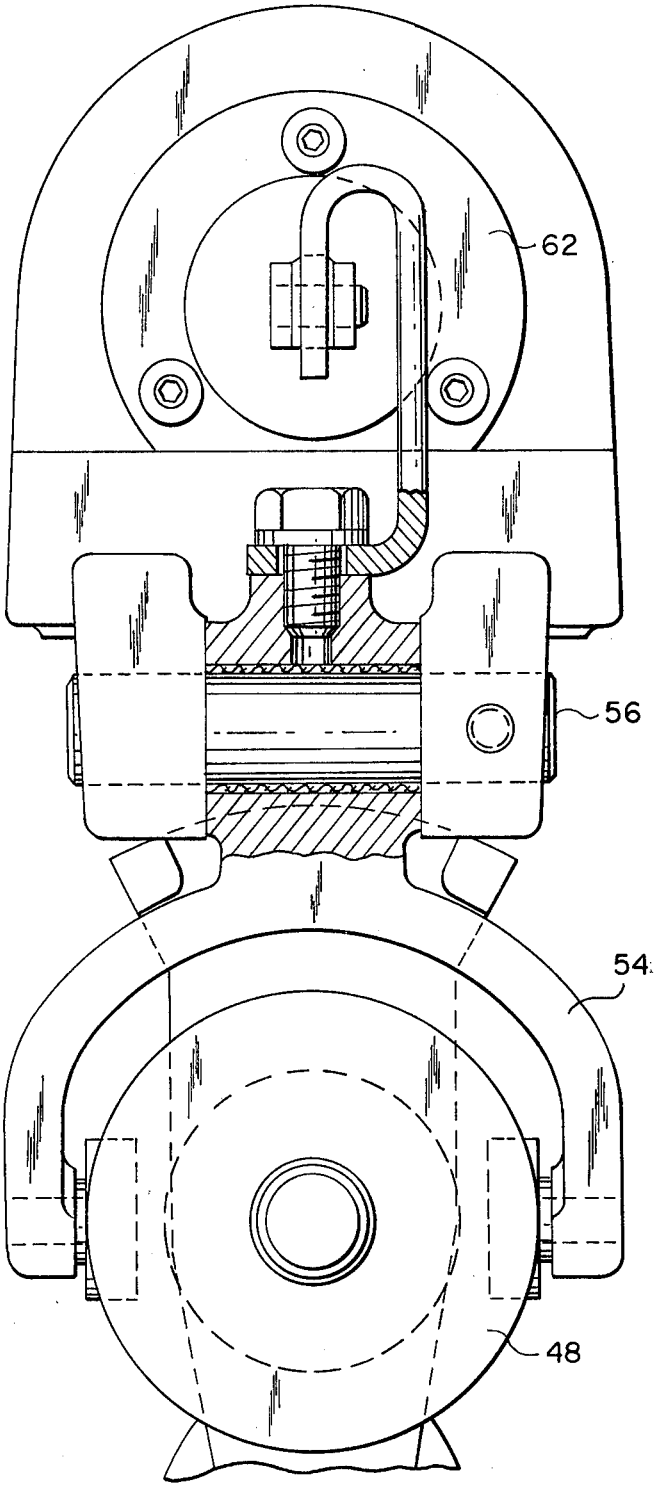
FIG. 4 illustrates the structural detail of FIG. 2.

FIG. 4 shows a view of FIG. 2 wherein the gear shift sleeve 48, the shift fork 54, the hinge joint 56, and the electromagnet 62 are visible in a top plan view.

With each weft insertion, the drive shaft 4 executes one full revolution, whereby the Maltese cross 12 is further rotated by its recess 10 by means of the pin 8. This rotary movement is transmitted, in a geared-down and self-locking manner by means of the worm gear 18, to the worm gear 20, and from there via the change gears 30 and 32 and the bevel gears 38 and 40 by means of the jaw clutch 72 to the shaft 42 and the gear 68 thereon, which actuates the take-up roller 82. Accordingly, the take-up roller is forcibly moved in a stepwise manner.

If, because of a defect at the loom, one or several wefts have not been inserted, the cloth has nevertheless continued to move on by way of the take-up roller. It must now travel back reprodicibly according to the number of the wefts that had not been inserted, for which reason the shaft 4 executes full revolutions in the opposite sense of rotation corresponding to the number of wefts which were not inserted, and therewith lets the cloth travel back by way of the aforementioned gear and associated means precisely by the extent that must be present for inserting the wefts which were not inserted. Hence the take-up regulator 2 is fully effective in both the forward and the reverse movements of its driving means.

If it is intended that the take-up motion be stopped for a specific number of wefts, the electromagnet 62 is actuated, whereby the crankpin 8 and the Maltese cross 12 will be disengaged, and now also the take-up motion is no longer actuated. Once the wefts have been recovered, the pin 8 will once again be in operative connection with the Maltese cross 12, and the regulator 2 continues to operate.

A stretching or loosening of the cloth by way of the take-up roller is possible manually by releasing the jaw clutch 72 and by rotating the hand-wheel 76.

Figure 5:
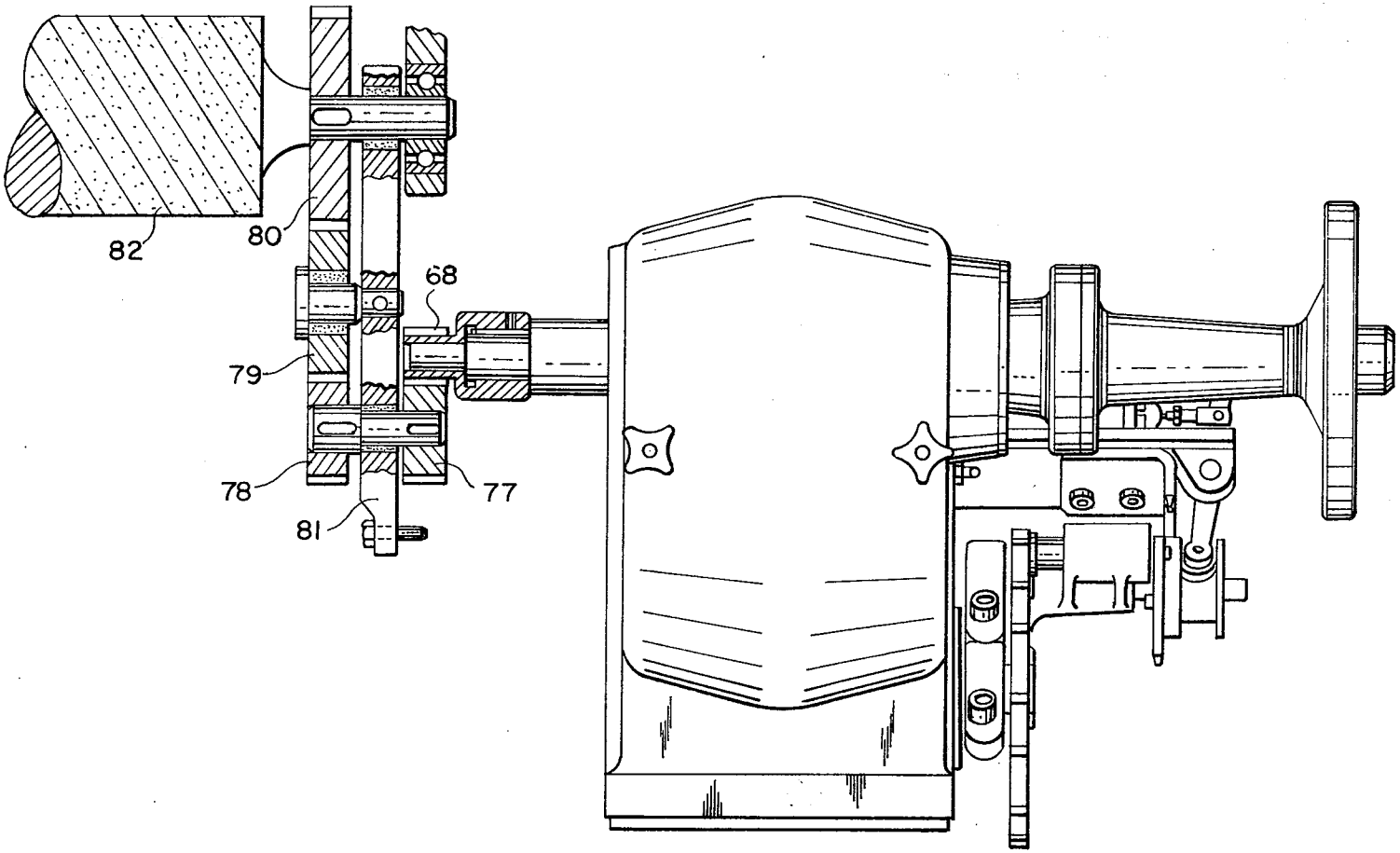
FIG. 5 illustrates take-up motion in conjunction with a take-up roller.

FIG. 5 shows the connection of the take-up motion 2 with the take-up roller 82 by means of a reduction gear train 68, 77, 78, 79 and 80, known in the art. Change gear 77 and intermediate gears 78 and 79 are fitted on an adjustable gear bracket 81.

It will be obvious to those skilled in the art that many modifications may be made within the scope of the present invention without departing from the spirit thereof, and the invention includes all such modifications.

What is claimed is:

1. In a cloth take-up motion for looms with gradual taking-up of the cloth in which a take-up roller is adapted to be driven by drive shaft means and gear system means, and wherein the drive shaft executes one revolution with each weft, the improvement which comprises crank means and pin means on said drive shaft means, means axially displaceably mounting said pin means in said crank means, Maltese cross means in which said pin means is adapted to engage, electromagnet means and shifting linkage means whereby said pin means is adapted to be engaged in and disengaged from said Maltese cross means, and reduction gear means connecting said Maltese cross means with said take-up roller.

2. A take-up motion according to claim 1 including self-locking worm gear means and change gear means connecting said Maltese cross means and said take-up roller.

3. A take-up motion according to claim 1 including clutch means adapted to uncouple said take-up roller, and handwheel means for rotating said take-up roller.

* * * * *